United States Patent [19]

Kurtz et al.

[11] Patent Number: 5,070,793

[45] Date of Patent: Dec. 10, 1991

[54] TOP CHORD MEMBER FOR RAILWAY CARS

[75] Inventors: William E. Kurtz, Johnstown; James T. Brown, Central City, both of Pa.

[73] Assignee: Bethlehem Steel Corporation, Bethlehem, Pa.

[21] Appl. No.: 639,459

[22] Filed: Jan. 10, 1991

[51] Int. Cl.[5] ..... B61D 17/08

[52] U.S. Cl. ..... 105/406.1; 105/404

[58] Field of Search ..... 105/404, 406.1, 41, 105/411, 241.2, 261.1, 263, 264, 270, 239, 396; 414/375; 296/187, 188, 193, 203, 184, 36; 52/731, 726

[56] References Cited

U.S. PATENT DOCUMENTS

| | | | |
|---|---|---|---|
| 742,549 | 10/1903 | Zeh et al. | 52/731 |
| 2,748,723 | 6/1956 | Swann | 105/406 |
| 3,833,135 | 9/1974 | Larsen | 214/64.2 |
| 3,866,545 | 2/1975 | Heap | 105/406 |
| 3,974,619 | 8/1976 | Turner | 52/726 |
| 4,252,067 | 2/1981 | Stark | 105/406 |
| 4,561,361 | 12/1985 | Adams | 105/406 |
| 4,840,127 | 6/1989 | Tomaka | 105/406 |
| 4,977,722 | 12/1990 | Taylor | 52/731 |

*Primary Examiner*—Robert J. Oberleitner
*Assistant Examiner*—Mark T. Le
*Attorney, Agent, or Firm*—John I. Iverson

[57] ABSTRACT

A sidewall and top chord member for an open top gondola or hopper railway car. The top chord member is a lightweight rectangular tubular extrusion of aluminum having a pair of spaced wear pads on the top surface thereof to contact rotary or shaker type car unloading equipment.

3 Claims, 1 Drawing Sheet

TOP CHORD MEMBER FOR RAILWAY CARS

BACKGROUND OF THE INVENTION

This invention relates to a top chord member used in the construction of the sidewalls of a gondola or hopper type railway car. It relates particularly to an aluminum top chord member especially suitable for railway cars constructed substantially of aluminum sheet and plate. It also relates to an aluminum top chord member especially adapted for use in railway cars which are unloaded in a rotary car inversion unloading device or in a vibrating shakeout machine both of which facilitate the unloading of bulk material from the car.

Open top gondola or hopper type railway cars are generally comprised of a metal floor, sidewalls and end walls. While such cars have most frequently been made of steel, many cars are being made substantially of aluminum sheet and plate to reduce the overall weight of the car and thereby increase its carrying capacity. The sidewalls of the gondola and hopper cars are stiffened and reinforced by a plurality of spaced, parallel, vertical side posts. A longitudinal top chord member extends along the tops of each sidewall and the side posts to further strengthen the sidewalls of the car.

Open top gondola railway cars that are used to carry bulk materials, such as coal, are frequently unloaded in a rotary car dumper which is a device that clamps onto the top chords of the sidewalls of the car and rotates the entire car and its contents to an inverted position to quickly unload the contents. Another unloading device, often used for hopper cars, is a car shaker that also clamps onto the top chords of the sidewalls of the car and imparts vibrating or shaking forces to the car to dislodge its contents and facilitate its unloading. Both of these car unloading devices impart concentrated and unusual localized forces to the top chord members of the car.

In the past, railway car designers have recognized the need for special top chord members to accept these unloading operations.

U.S. Pat. Nos. 2,748,723, and 4,561,361 disclose hot rolled steel bulb sections which are especially designed to accommodate rotary car dumpers or car shaker devices. While these rolled bulb sections have proven satisfactory for cars and top chord members made of steel, they have lacked sufficient strength and integrity when used for aluminum cars and top chord members. U.S. Pat. No. 4,840,127 is an example of a top chord member designed especially for use in aluminum gondola or hopper cars in which the top chord member is a rectangular, tubular extrusion having a thickened stem portion to better resist bending moments where the top chord is fastened to the sheets and posts that make up the sidewall of the car. Such a top chord, while more suitable for aluminum cars than the rolled bulb angle, lacks sufficient strength and integrity for extended use in the rotary or shaker type car unloading devices.

SUMMARY OF THE INVENTION

It is therefore an object of this invention to provide a top chord member for an aluminum gondola or hopper railway car that is strong, lightweight and suitable for extended use in rotary or shaker type car unloading devices.

It has been discovered that the foregoing objectives can be attained by a rectangular, tubular top chord member made from an aluminum extrusion in which the top chord member is comprises of parallel top and bottom walls, parallel sidewalls and an attachment leg extending below the bottom wall as an extension of one of the sidewalls. The top wall of the top chord member has portions adjacent to the sidewalls which are considerably thicker than the center portion of the top wall and the sidewalls and the bottom wall.

DESCRIPTION OF THE PREFERRED EMBODIMENT

Figure 1:
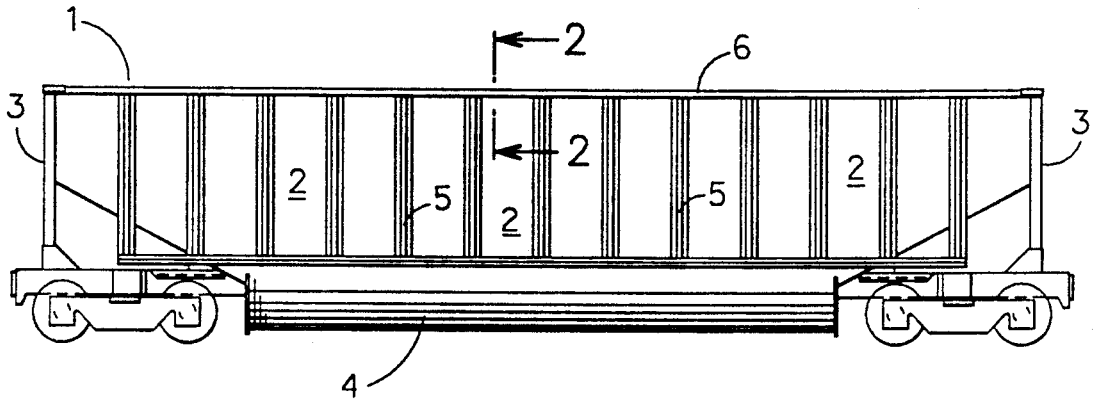
FIG. 1 is an elevational view of an open top gondola car of this invention having a top chord member according to this invention.
Figure 2:
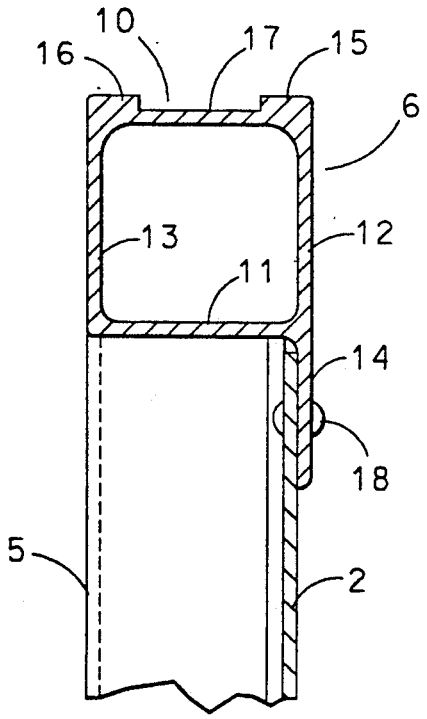
FIG. 2 is a sectional view of the gondola car of FIG. 1, taken along section lines 2—2.

The preferred embodiment of the top chord member of this invention is shown in FIGS. 1 and 2. FIG. 1 illustrates an open top gondola railway car 1 having a pair of sidewalls 2, a pair of end walls 3 and a concave floor structure 4. The sidewalls 2 are stiffened and reinforced by a plurality of spaced, parallel, vertical side posts 5. A longitudinal top chord member 6 extends along the top of each sidewall 2 and the tops of side posts 5 and is fastened to further strengthen the sidewalls 2 of the car 1.

As best shown in sectional view FIG. 2, the top chord member 6 comprises a rectangular, tubular aluminum extrusion having a top wall 10 and a bottom wall 11 parallel to each other and an inner sidewall 12 and an outer sidewall 13 parallel to each other. An attachment leg 14 extends below the bottom wall 11 as an extension of inner sidewall 12. As shown in FIG. 2, this attachment leg 14 is used to fasten the top chord member 6 to the sidewall sheets 2 and side posts 5 with rivets 18 or other suitable fasteners. The bottom wall 11 of the top chord member 6 bears directly on the tops of the side posts 5.

The top wall 10 of top chord member 6 has an inner portion 15 and an outer portion 16 adjacent to the respective sidewalls 12 and 13 which are considerably thicker than the central portion 17 of the top wall 10 or the sidewalls 12 and 13 on the bottom wall 11. The thicker portions 15 and 16 serve as a pair of contact surfaces or wear pads which contact the rotary car dumper or car shaker devices and transfer the forces from those unloading devices to the car structure. Having a pair of such contact points not only reduces the wear on the top chord member 6 but provides better protection to the top chord member 6 from damage as these car unloading devices are clamped onto the top chord member 6. The pair of contact surfaces or wear pads 15 and 16 insures that the forces from the unloading devices are uniformly distributed between the sidewalls 2 and the side posts 5. In addition, the use of a thinner portion 17 between the two thicker portions 15 and 16 of the top wall 10 of the top chord member 6 provides a better and more uniform distribution of lateral bending stress in the top chord member 6.

A specific examples of a top chord member 6 of this invention used a 5 inch (12.7 cm) square tubular extrusion of 6061-T6 aluminum with a 3.25 inch (8.255 cm) long attachment leg 14. Sidewalls 12 and 13, and attachment leg 14 were all 0.30 inches (0.76 cm) thick. Bottom wall 11 was 0.25 inches (0.635 cm) thick. Top wall 10 had thicker portions on wear pads 15 and 16, 1.1875 inches (3.02 cm) wide and 0.625 inches (1.59 cm) thick. The central portion 17 was 0.30 inches (0.76) thick and 2.62 inches (6.65 cm) wide.

The foregoing description and preferred example explain and illustrate the invention and the invention is not limited thereto, except as defined by the claims. Those skilled in the art of rail car design will be able to make modifications and variations without departing from the scope of this invention.

We claim:

1. A rectangular, tubular top chord member extending longitudinally along the top of a sidewall and the tops of side posts of an open top railway car, said top chord member comprising parallel top and bottom walls and parallel sidewalls and an attachment leg extending below said bottom wall as an extension of one of said sidewalls said top wall having portions adjacent to said sidewalls thicker than the center portion of said top wall and said sidewalls and said bottom wall, said thicker portions adapted to serve as wear pads when said top chord member is clamped in a railway car unloading device.

2. The top chord member of claim 1 where said chord member is an aluminum extrusion.

3. The top chord member of claim 1 wherein the top wall portions adjacent to said sidewalls are at least twice as thick as the center portion of said top wall and said sidewalls and said bottom wall.

* * * * *